US010781822B2

(12) United States Patent
Chan et al.

(10) Patent No.: US 10,781,822 B2
(45) Date of Patent: Sep. 22, 2020

(54) FAN IMPELLER WITH METALLIC BLADES AND METHOD FOR MANUFACTURING THE SAME

(71) Applicant: COOLER MASTER CO., LTD., New Taipei (TW)

(72) Inventors: Wei-Lung Chan, New Taipei (TW); Tsung-Wei Lin, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 1134 days.

(21) Appl. No.: 14/844,535

(22) Filed: Sep. 3, 2015

(65) Prior Publication Data

US 2016/0273546 A1 Sep. 22, 2016

(30) Foreign Application Priority Data

Mar. 20, 2015 (CN) ..... 2015 1 0124800

(51) Int. Cl.
*F04D 29/28* (2006.01)
*F04D 29/02* (2006.01)
(Continued)

(52) U.S. Cl.
CPC ..... *F04D 29/282* (2013.01); *F04D 29/023* (2013.01); *F04D 29/281* (2013.01); *F04D 29/30* (2013.01); *F04D 29/624* (2013.01); *F05D 2230/23* (2013.01); *F05D 2230/54* (2013.01); *F05D 2300/10* (2013.01); *F05D 2300/43* (2013.01)

(58) Field of Classification Search
CPC .... F04D 29/023; F04D 29/281; F04D 29/282; F04D 29/30; F04D 29/624; F04D 29/326; F05D 2230/23; F05D 2230/54; F05D 2300/10; F05D 2300/43; B23D 59/006
USPC ..... 416/182, 195, 169 A; 415/203; 30/124
See application file for complete search history.

(56) References Cited

U.S. PATENT DOCUMENTS 2,220,669 A 11/1940 Allen
5,419,682 A 5/1995 Martin
(Continued)

FOREIGN PATENT DOCUMENTS

CN 203175946 U 9/2013
CN 103573717 A 2/2014
(Continued)

OTHER PUBLICATIONS

English Machine Translation of CN204511971U, translated from Espacenet on Apr. 5, 2020. (Year: 2015).*
(Continued)

*Primary Examiner* — Patrick Hamo
*Assistant Examiner* — Paul W Thiede
(74) *Attorney, Agent, or Firm* — Maschoff Brennan

(57) ABSTRACT

A fan impeller has a fan hub, an outer circular frame surrounding the fan hub, and metallic blades independent from one another. Two ends of each of the metallic blades are a root and a distal end respectively, at least a portion of the root is embedded in the fan hub, and at least a portion of the distal end is embedded in the outer circular frame. The metallic blades, the plastic fan hub and the plastic outer circular frame are connected by means of insert molding, so that the number of the blades can be increased to provide increased air output.

6 Claims, 13 Drawing Sheets

(51) Int. Cl.
*F04D 29/30* (2006.01)
*F04D 29/62* (2006.01)

(56) References Cited

U.S. PATENT DOCUMENTS

| | | | | |
|---|---|---|---|---|
| 5,755,557 | A * | 5/1998 | Alizadeh | F04D 29/326 416/169 A |
| 9,512,726 | B2 | 12/2016 | Ren et al. | |
| 10,001,128 | B2 * | 6/2018 | Lin | F04D 29/281 |
| 2005/0106024 | A1 | 5/2005 | Vasilescu et al. | |
| 2010/0269353 | A1 * | 10/2010 | Martin | B23D 59/006 30/124 |
| 2012/0141261 | A1 * | 6/2012 | Giovannetti | F04D 29/023 415/203 |
| 2014/0205459 | A1 * | 7/2014 | Dobie | F04D 29/023 416/195 |

FOREIGN PATENT DOCUMENTS

| | | | |
|---|---|---|---|
| CN | 104033419 | A | 9/2014 |
| CN | 204511971 | U * | 7/2015 |
| DE | 3941612 | A1 | 6/1991 |
| JP | 2004027870 | A | 1/2004 |

OTHER PUBLICATIONS

Derwent English Abstract of CN20451971U. (Year: 2015).*
English Machine Translation of CN104033419A, translated from Espacenet on Apr. 6, 2020. (Year: 2014).*
Search Report dated Aug. 16, 2016 of the corresponding European patent application.

* cited by examiner

FAN IMPELLER WITH METALLIC BLADES AND METHOD FOR MANUFACTURING THE SAME

TECHNICAL FIELD

The present invention relates to a heat-dissipating fan and, in particular, to a fan impeller having metallic blades and a method for manufacturing the fan impeller.

BACKGROUND

Conventional heat-dissipating fans are mostly a structure in which blades and a fan hub are integrally formed. Such a structure is of simple construction and may be easily produced by a simple manufacturing process, which enables production of a small and slim type heat-dissipating fan. The minimum thickness of a blade in this structure is subject to the plastic structural strength and the skill and technique with which an injection molding process is performed. As a result, no more blades can be added in the limited space of this structure, so further improvement in the performance of the conventional heat dissipating fans cannot be obtained.

In view of the foregoing, the inventor made various studies to improve the above-mentioned problems, on the basis of which the present invention is accomplished.

SUMMARY

The present invention provides a fan impeller having metallic blades and a method for manufacturing the fan impeller.

The present invention provides a fan impeller including a fan hub, an outer circular frame, and a plurality of metallic blades independent from one another. Two ends of each of the metallic blades are a root and a distal end, respectively. At least a portion of the root is embedded in the fan hub, and at least a portion of the distal end is embedded in the outer circular frame.

It is preferable that the distal end includes a retention pin that outwardly extends away from a bend of the distal end so that the bend and the retention pin of the distal end, in combination, embeddingly extend in the outer circular frame along a circumference direction of the outer circular frame. There can be a through hole formed on the distal end, and at least a portion of the outer circular frame is disposed in the through hole. The outer circular frame includes a first thickness and an engagement segment which is inserted in one of the through holes, and the engagement segment has a second thickness which is less than the first thickness. A shape of a cross-section of the engagement segment mates with the shape of the one of the through hole. Each of the metallic blades is curve-shaped, and each of the metallic blades has an edge along a line of curvature extending between the root and the distal end of the metallic blade. The root is hook-shaped.

The present invention further provides a method for manufacturing a fan impeller, comprising: providing a plurality of metallic blades independent from one another; providing a first forming mold; positioning the metallic blades arranged in a radial pattern in the first forming mold; forming in the first forming mold an inner circular frame and an outer circular frame having a spaced, radially outbound relationship with respect to the inner circular frame by means of insert molding, and insert-molding two ends of each of the metallic blades into the inner circular frame and the outer circular frame respectively; providing a rotation shaft unit and a motor circular cover; providing a second forming mold; arranging the rotation shaft unit, the motor circular cover, and the connected inner circular frame, outer circular frame and metallic blades in the second forming mold, so that the inner circular frame surrounds the motor circular cover, and the motor circular cover surrounds the rotation shaft unit; and performing insert molding in the second forming mold to cover the inner circular frame, the motor circular cover, and the rotation shaft unit to form a fan hub.

It is preferable that two ends of each of the metallic blades are a root and a distal end respectively, at least a portion of the root is embedded in the fan hub, and at least a portion of the distal end is embedded in the outer circular frame. The distal end forms an engagement member, and the outer circular frame is engaged with the distal end by means of the engagement member. The engagement member can be a retention pin, the retention pin outwardly extends away from a bend of the distal end so that the bend and the retention pin of the distal end, in combination, embeddingly extend in the outer circular frame along a circumference direction of the outer circular frame. The engagement member can be a through hole, and at least a portion of the outer circular frame is disposed in the through hole. The outer circular includes a first thickness and an engagement segment which is inserted in one of the through holes, and the engagement segment has a second thickness which is less than the first thickness, and a shape of a cross-section of the engagement segment mates with the shape of the one of the through holes. Each of the metallic blades is curve-shaped, and each of the metallic blades has an edge along a line of curvature extending between the root and the distal end of the metallic blade.

In the fan impeller and the method for manufacturing the same according to the present invention, the metallic blades, the plastic fan hub and the plastic outer circular frame are connected by means of insert molding, so that the number of the blades can be increased to provide increased air output.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
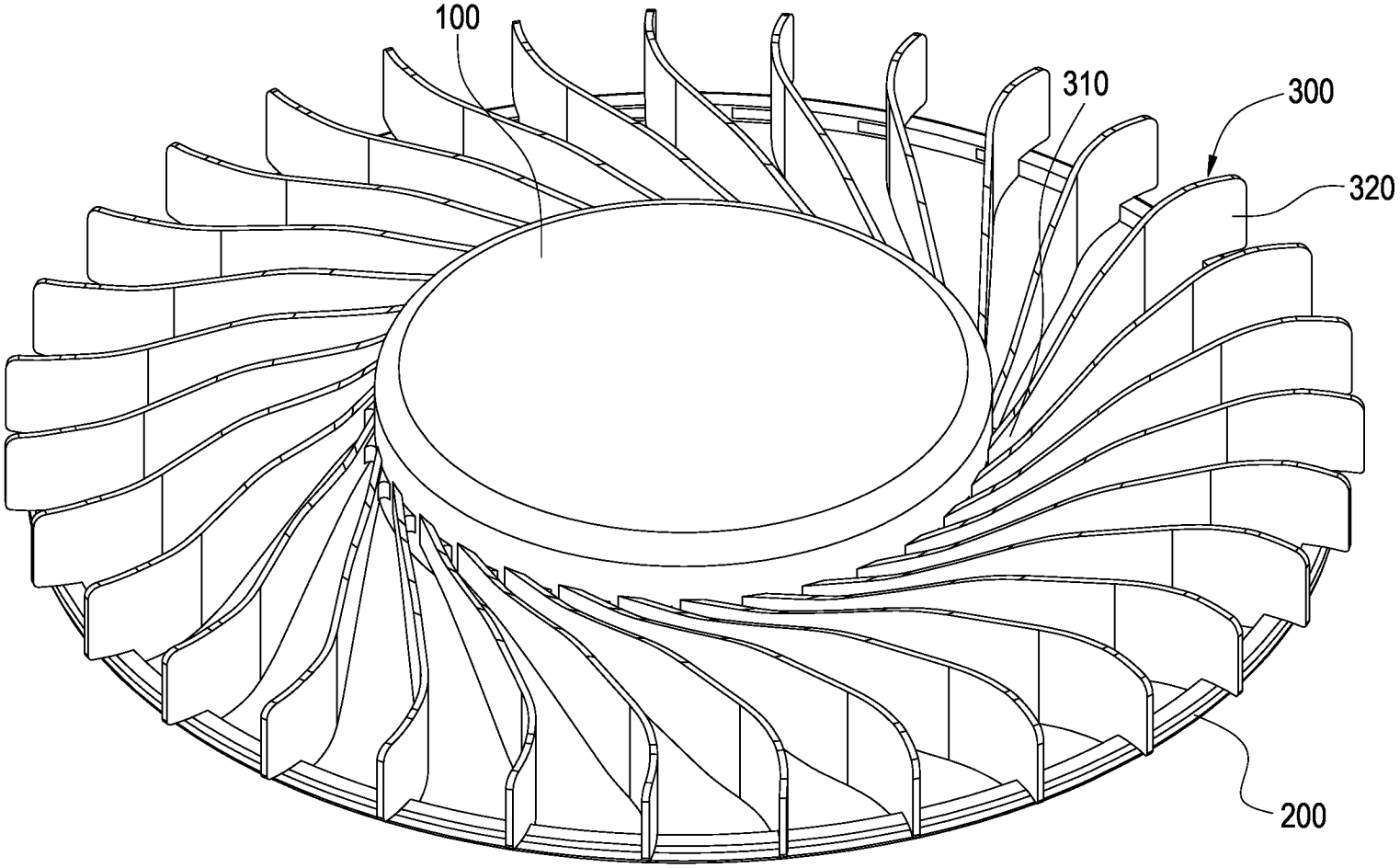
FIG. 1 is a perspective view of a fan impeller according to a first embodiment of the present invention.
Figure 2:
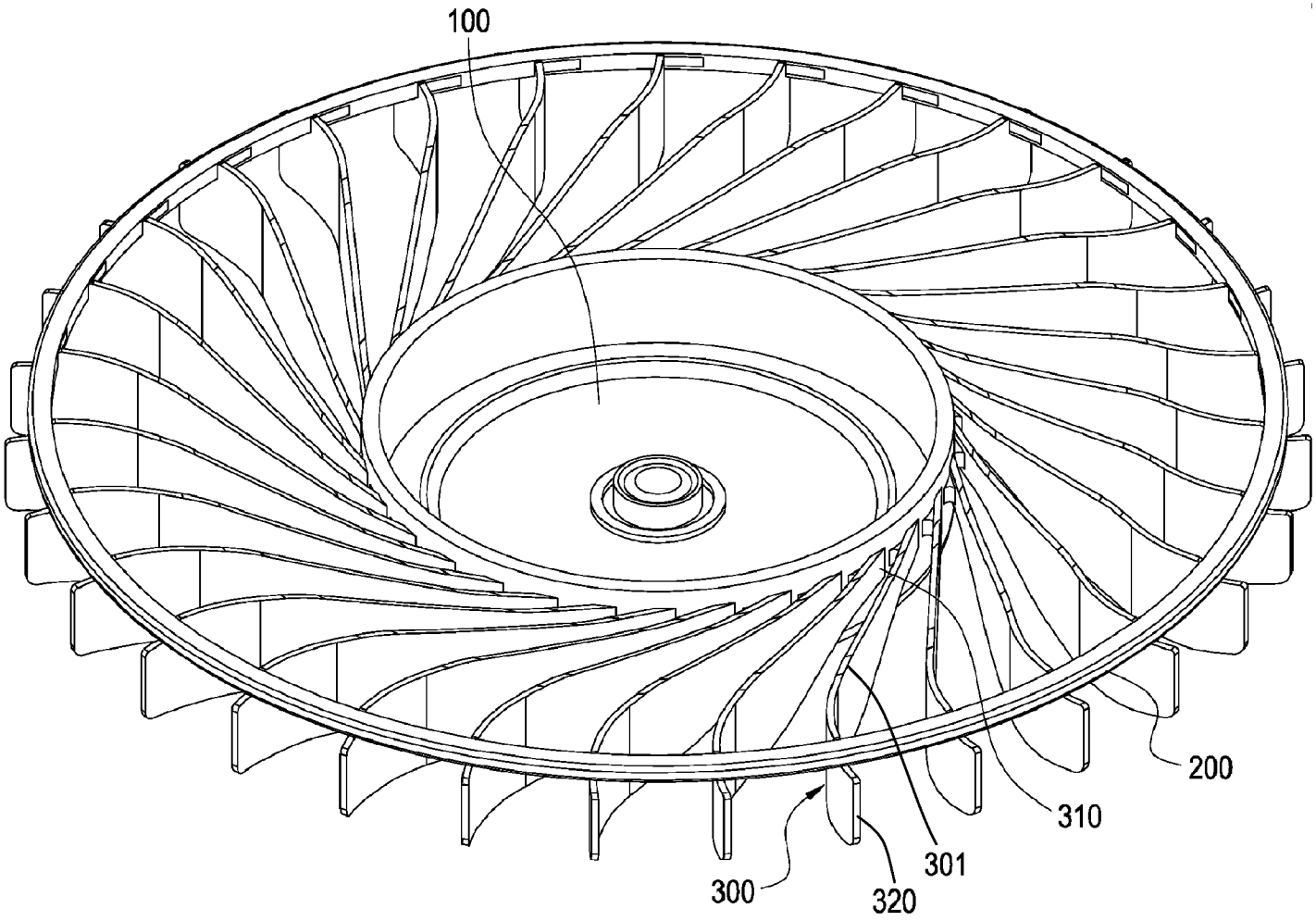
FIG. 2 is another perspective view of the fan impeller according to the first embodiment of the present invention.

Referring to FIGS. 1 and 2, a first embodiment of the present invention provides a fan impeller comprising a fan hub 100, an outer circular frame 200, and a plurality of metallic blades 300.

In the present embodiment, the fan hub 100 is preferably a plastic cap made by insert molding, and the fan hub 100 is a circular fan hub, and the present disclosure is not limited thereto. The outer circular frame 200 is preferably a plastic circular ring made by insert molding. The outer circular frame 200 has a spaced, radially outbound relationship with respect to the fan hub 100, and is disposed coaxially with the fan hub 100.

Figure 3:
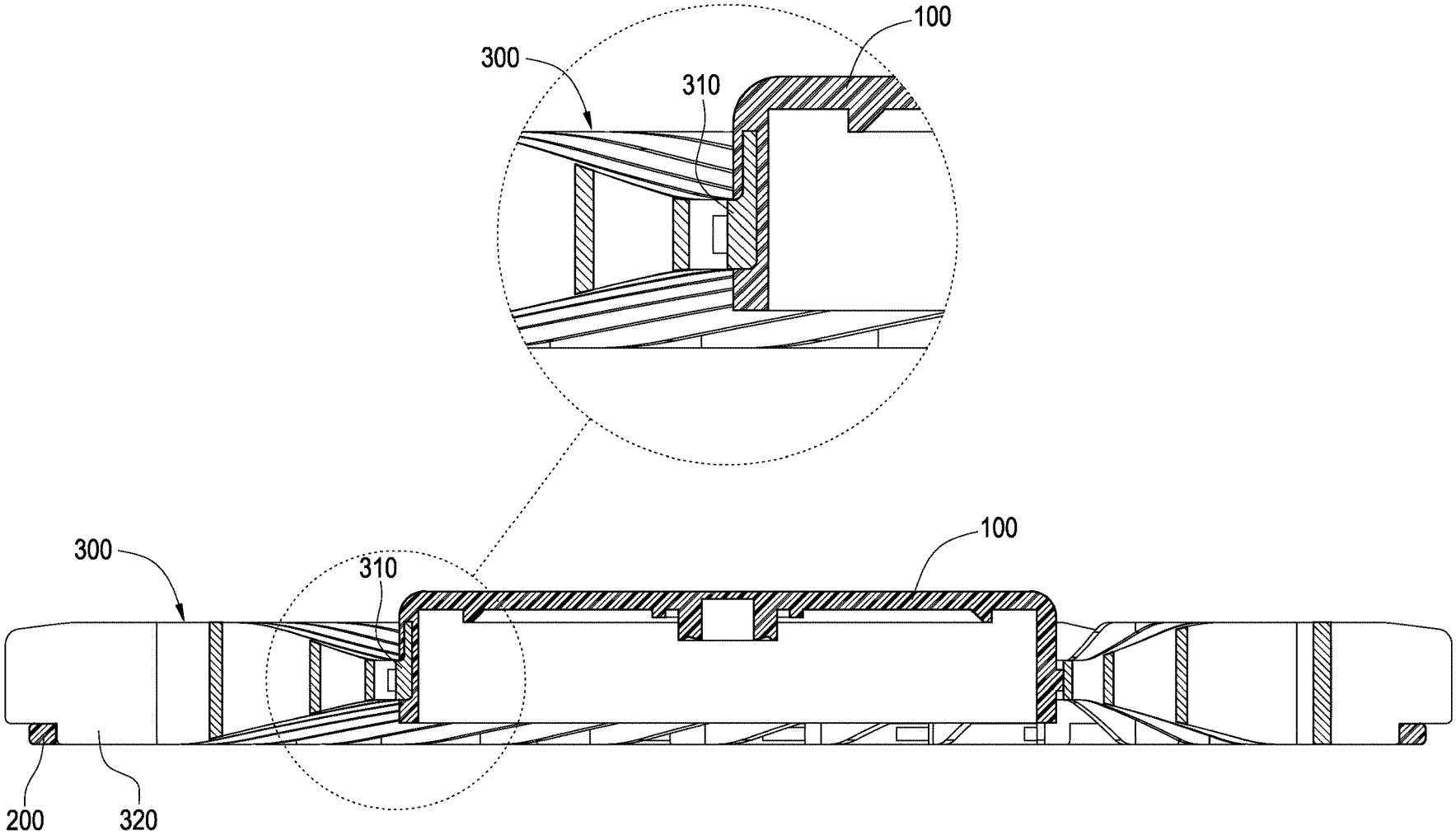
FIG. 3 is a radial cross-sectional view of the fan impeller according to the first embodiment of the present invention.
Figure 4:
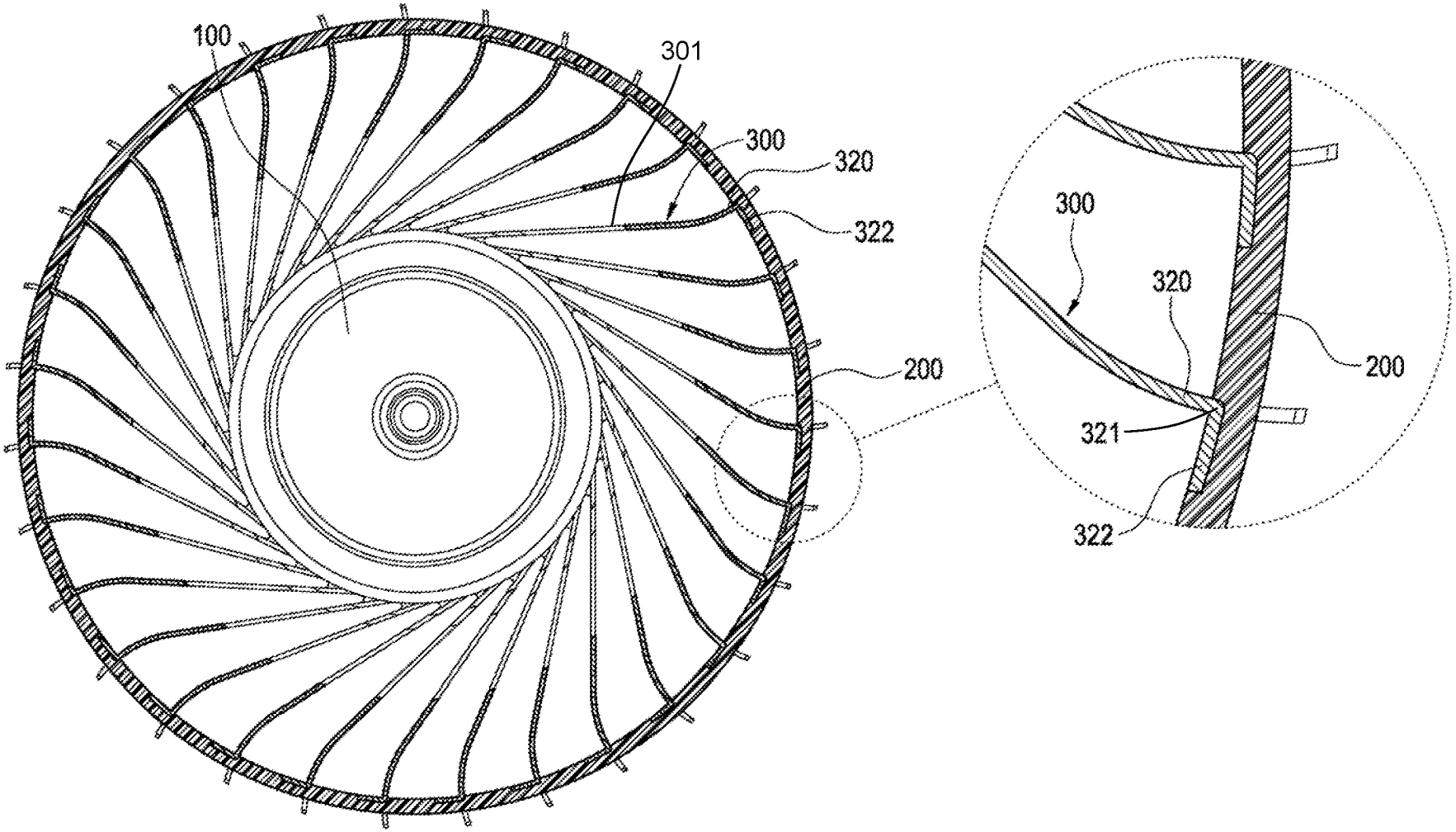
FIG. 4 is a transverse cross-sectional view of the fan impeller according to the first embodiment of the present invention.

Referring to FIGS. 3 and 4, each of the metallic blades 300 is preferably an elongated metallic plate made by pressing molding. Each metallic blade 300 can be selectively bent to form a curved shape as required. The metallic blades 300 are independent from one another. The metallic blades 300 can be all of the same type or can be of mixed types. Two ends of each of the metallic blades 300 are a root 310 and a distal end 320 respectively, and as seen in FIGS. 2 and 4, each of the metallic blades 300 has an edge 301 along a line of curvature extending between the root 310 and the distal end 320 of the metallic blade 300. The root 310 is hook-shaped, and at least a portion of the root 310 is embedded in and hook-engaged with the fan hub 100. In detail, the fan hub 100 is disposed along a longitudinal axis having a first axial end and a second axial end opposite the first axial end. The root 310 has a bend portion having a length, and the bend portion of the root 310 is embedded in the fan hub 100 at a position on the fan hub 100 intermediate the first axial end and the second axial end. At least a portion of the distal end 320 is embedded in the outer circular frame 200. The metallic blades 300 are secured in position by means of the fan hub 100 and the outer circular frame 200, so that the metallic blades 300 are arranged in a radial pattern. The present invention does not limit the arrangement of the metallic blades 300 when the metallic blades 300 are of mixed types.

Figure 5:
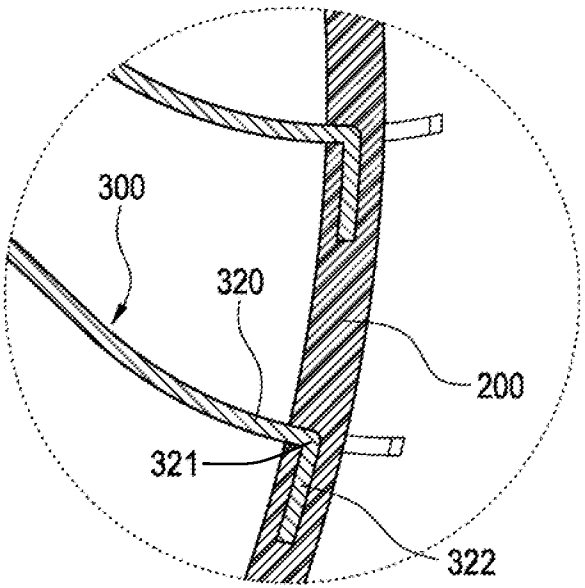
FIG. 5 is a schematic view of the first embodiment of the present invention, illustrating a possible variation of an engagement member of a metallic blade.

The distal end 320 includes a retention pin 322 that outwardly extends away from a bend 321 of the distal end 320 so that the bend 321 and the retention pin 322 of the distal end 320, in combination, embeddingly extend in the outer circular frame 200 along a circumference direction of the outer circular frame 200. The retention pin 322 and the bend 321 can be shallowly embedded into the outer circular frame 200 as shown in FIG. 4 and can be deeply embedded into the outer circular frame 200 as shown in FIG. 5, and the present invention is not limited thereto.

Figure 6:
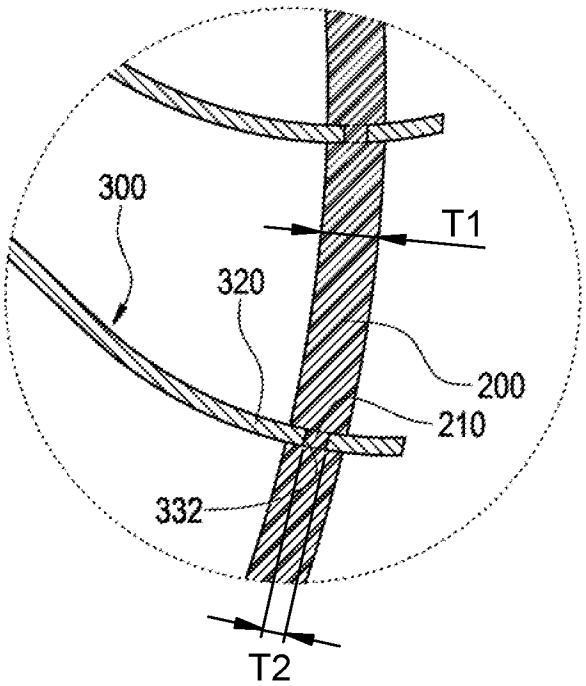
FIG. 6 is a partial cross-sectional view of the fan impeller according to a second embodiment of the present invention.

Referring to FIGS. 1 and 6, a second embodiment of the present invention provides a fan impeller comprising a fan hub 100, an outer circular frame 200, and a plurality of metallic blades 300. The structure of the second embodiment is similar to that of the first embodiment, and thus, similarities are omitted for brevity. The present embodiment is different from the first embodiment in that there is a through hole 332 formed on the distal end 320 of each of the metallic blades 300, and at least a portion of the outer circular frame 200 is disposed in each of the through holes 332, for example, in a manner so that a portion of the distal end 320 of each of the metallic blades 300 extends radially beyond an outer peripheral edge of the outer circular frame 200. It is preferable that the outer circular frame 200 includes a first thickness T1 and engagement segments 210 which respectively engage with the metallic blades 300 having a second thickness T2 less than the first thickness T1, a shape of a cross-section of each of the engagement segments 210 mates with the shape of a respective corresponding one of the through holes 332, and each of the engagement segments 210 is inserted in a respective corresponding one of the through holes 332.

A third embodiment of the present invention provides a method for manufacturing a fan impeller. In this embodiment, the method for manufacturing the fan impeller comprises steps as follows.

Figure 7:
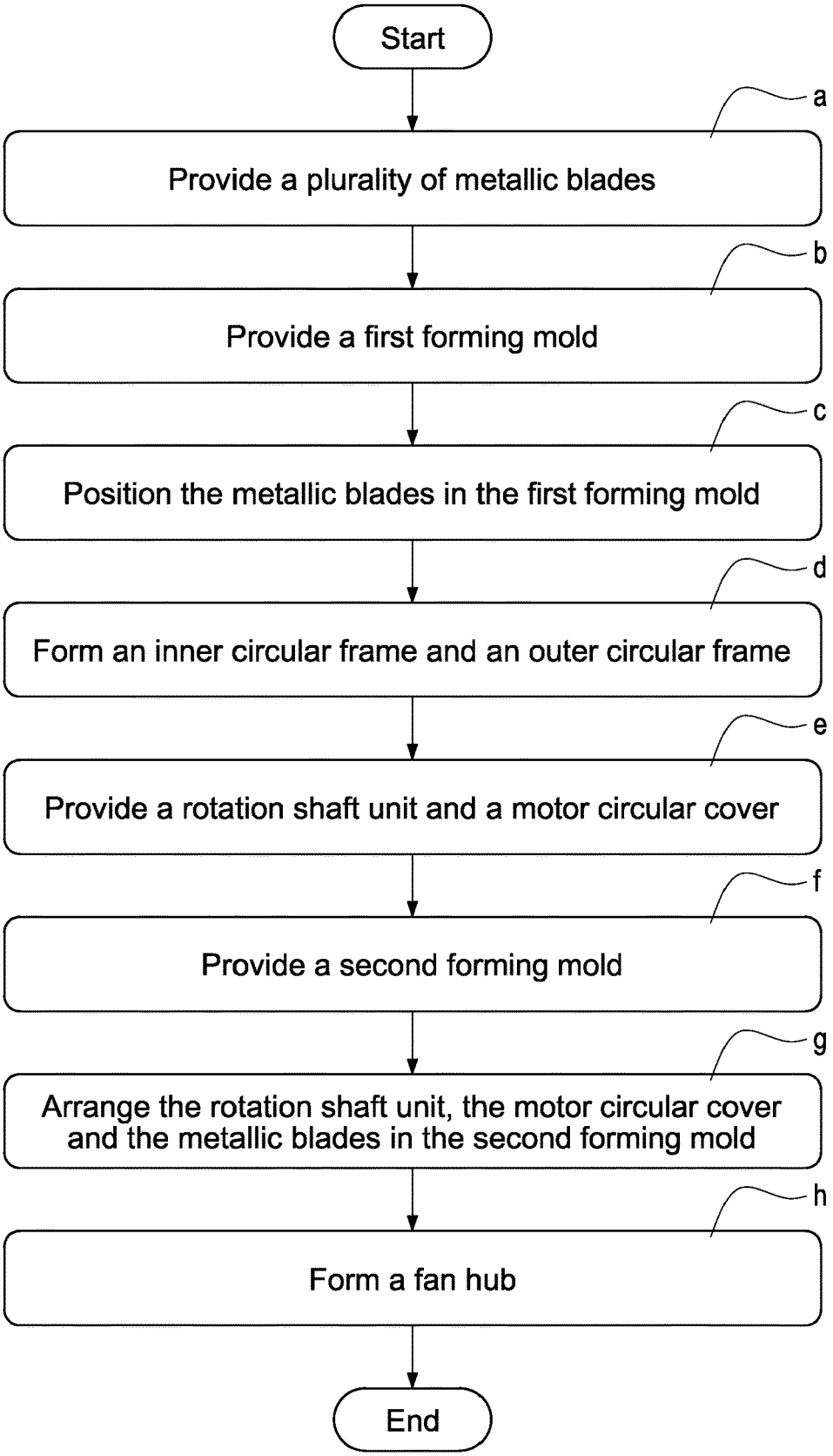
FIG. 7 is a process flow chart showing a method for manufacturing a fan impeller according to a third embodiment of the present invention.
Figure 8:
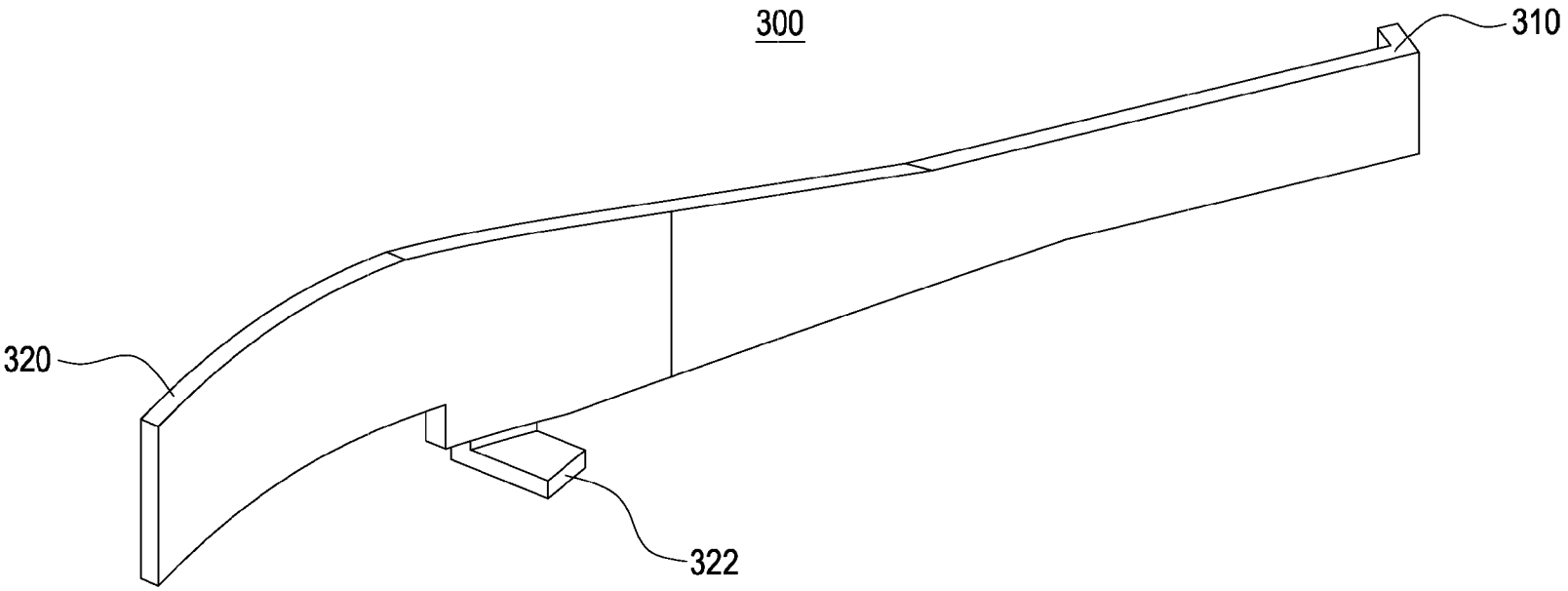
FIG. 8 is a perspective view illustrating a metallic blade provided in the method for manufacturing the fan impeller according to the third embodiment of the present invention.

Referring to FIGS. 7 and 8, in step a, a plurality of metallic blades 300 independent from one another are formed by impact molding. The number of the metallic blades 300 is not intended to be limited by the present invention. The number of the metallic blades 300 is determined depending on the requirement for designing the fan impeller. According to the requirement for designing the fan impeller, each of the metallic blades 300 can be selectively bent to form a desired curved shape. Each of the metallic blades 300 is preferable in an elongated shape. Two ends of each of the metallic blades 300 are a root 310 and a distal end 320 respectively. In the above-mentioned impact molding process, an engagement member is formed at the distal end 320 of each of the metallic blades 300. In the present embodiment, the engagement member is a retention pin 322 extending from the distal end 320 of each of the metallic blades 300. The retention pin 322 is bent and disposed corresponding to the outer circular frame 200. The foregoing description relates to the engagement member in the preferred embodiment, but is not intended to limit the engagement member of the present invention to any particular type or form. The engagement member can be, for example, a through hole 332 as described in the second embodiment.

Referring to FIG. 7, in step b following step a, a first forming mold (not illustrated) is provided.

Figure 9:
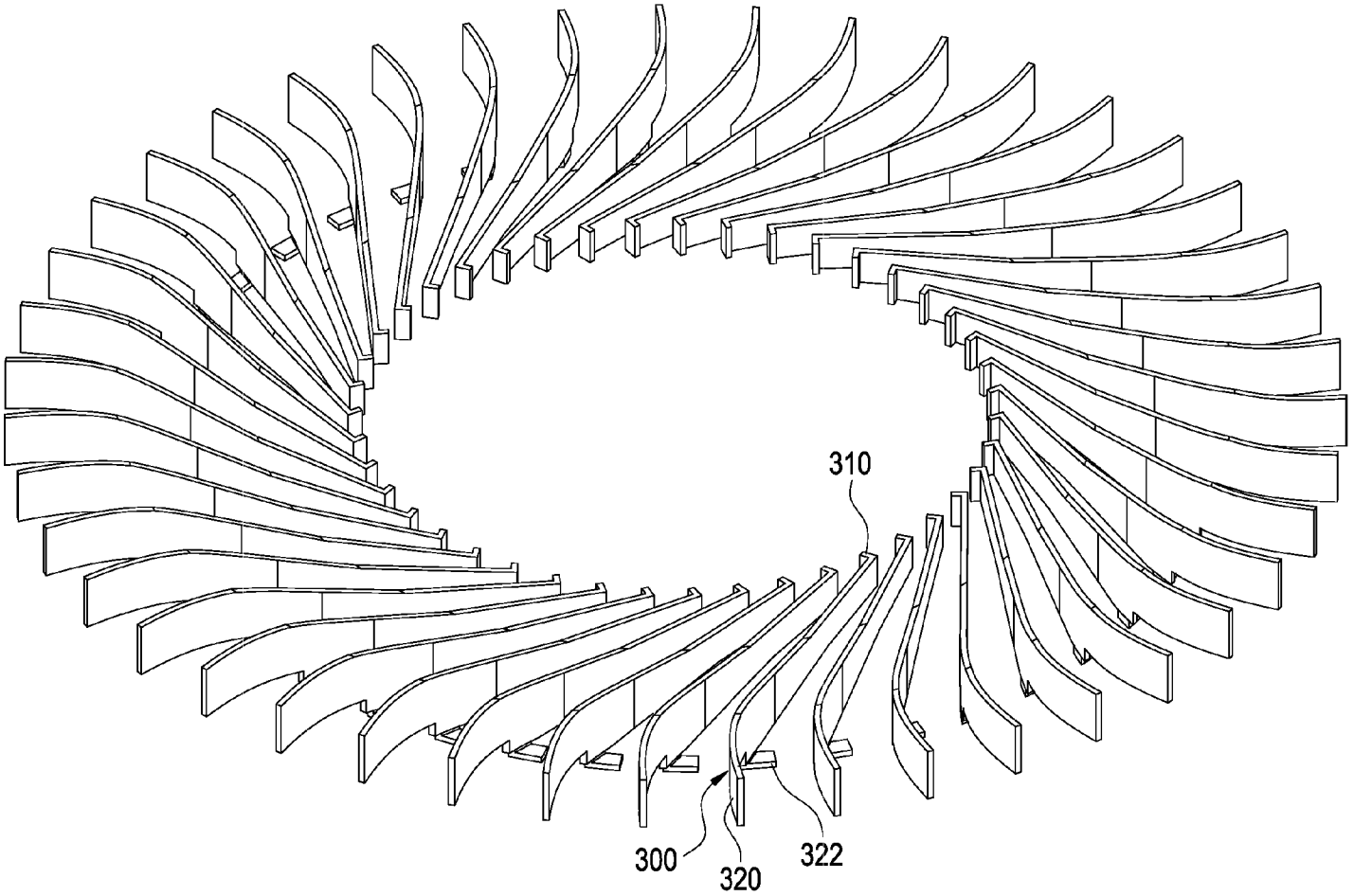
FIG. 9 is a schematic view of the third embodiment of the present invention, illustrating the arrangement of the metallic blades in the method for manufacturing the fan impeller.

Referring to FIGS. 7 and 9, in step c following the step b, the metallic blades 300 provided in the step a are arranged in a radial pattern and positioned in the first forming mold provided in the step b.

Figure 10:
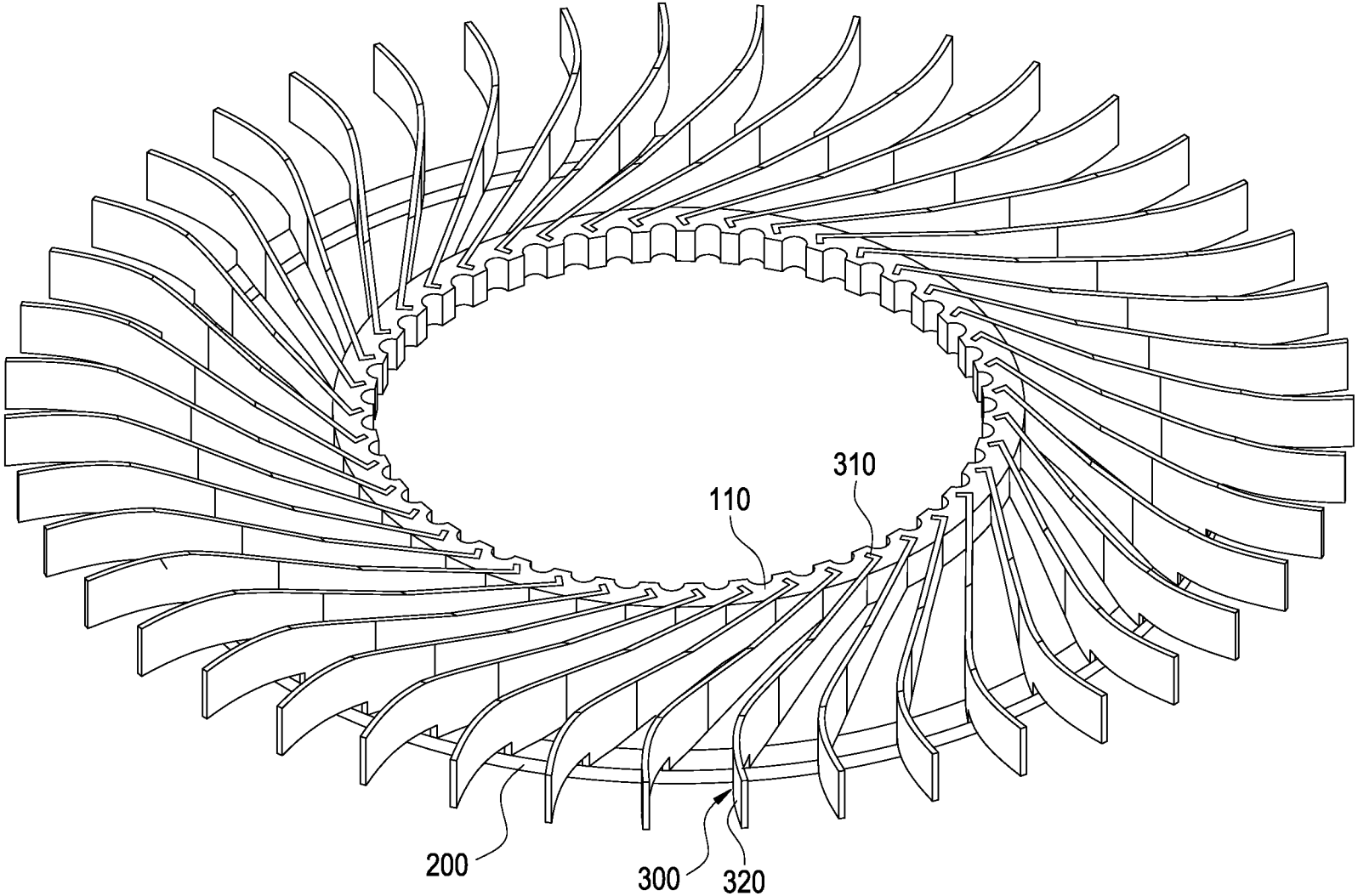
FIG. 10 is a schematic view of the third embodiment of the present invention, illustrating the metallic blades connected in the method for manufacturing the fan impeller.

Referring to FIGS. 7 and 10, in step d following the step c, an inner circular frame 110 and an outer circular frame 200 are formed in the first forming mold by insert molding. The inner circular frame 110 is preferably a plastic circular body, and the outer circular frame 200 is preferably another plastic circular body having a spaced, radially outbound relationship with respect to the inner circular frame 110 and disposed coaxially with the inner circular frame 110. In the step d, two ends of each of the metallic blades 300 are insert-molded in the inner circular frame 110 and the outer circular frame 200, respectively. The metallic blades 300 are secured in respective positions with respect to one another by means of the inner circular frame 110 and outer circular frame 200. At least a portion of the root 310 of each metallic blade 300 is insert-molded in the inner circular frame 110, and the retention pin 322 of the distal end 320 of each metallic blade 300 is insert-molded in the outer circular frame 200. Therefore, the outer circular frame 200 is engaged with the distal end 320 of each metallic blade 300 by means of the engagement member.

When the engagement member is the through hole 332, the outer circular frame 200 includes a first thickness T1 and engagement segments 210 respectively corresponding to the metallic blades 300 having a second thickness T2 less than the first thickness T1, a shape of a cross-section of each engagement segment 210 mates with the shape of a respective corresponding one of the through hole 332, and each of the engagement segments 210 is inserted in a respective corresponding one of the through holes 332.

Figure 11:
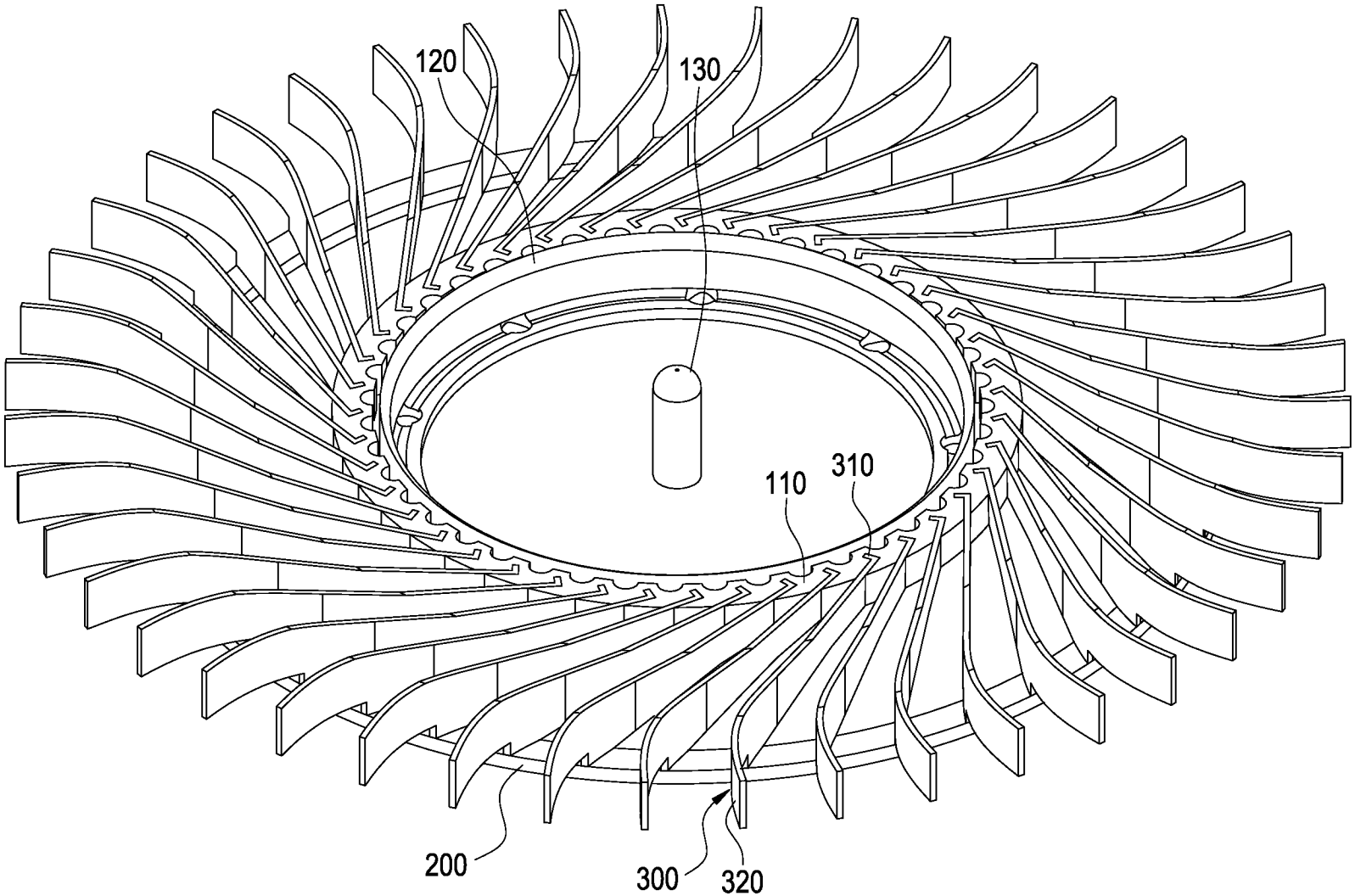
FIG. 11 is a schematic view of the third embodiment of the present invention, illustrating the arrangement of a motor circular cover and a rotation shaft unit in the method for manufacturing the fan impeller.

Referring to FIGS. 7 and 11, step e and step f are executed after the step d, the step e and the step f need not be performed in a particular order. In the step e, a motor circular cover 120 and a rotation shaft unit 130 are provided. The motor circular cover 120 is preferably a circular cover made of metal. The rotation shaft unit 130 can be a metallic rod as shown in FIG. 11, or can be a metallic cylinder for insertion of the metallic rod. In the step f, a second forming mold (not illustrated) is provided. In the second forming mold, there are disposed the foregoing connected inner circular frame 110, outer circular frame 200 and metallic blades 300, the motor circular cover 120 and the rotation shaft unit 130.

Referring to FIGS. 7 and 11, the step g is executed after the execution of the step e and the step f. In the step g, the motor circular cover 120 and the rotation shaft unit 130 provided in the step e are placed in the second forming mold provided in the step f, and the motor circular cover 120 is arranged to surround the rotation shaft unit 130; the connected inner circular frame 110, outer circular frame 200 and metallic blades 300 are arranged in the second forming mold, and the inner circular frame 110 surrounds the motor circular cover 120.

Figure 12:
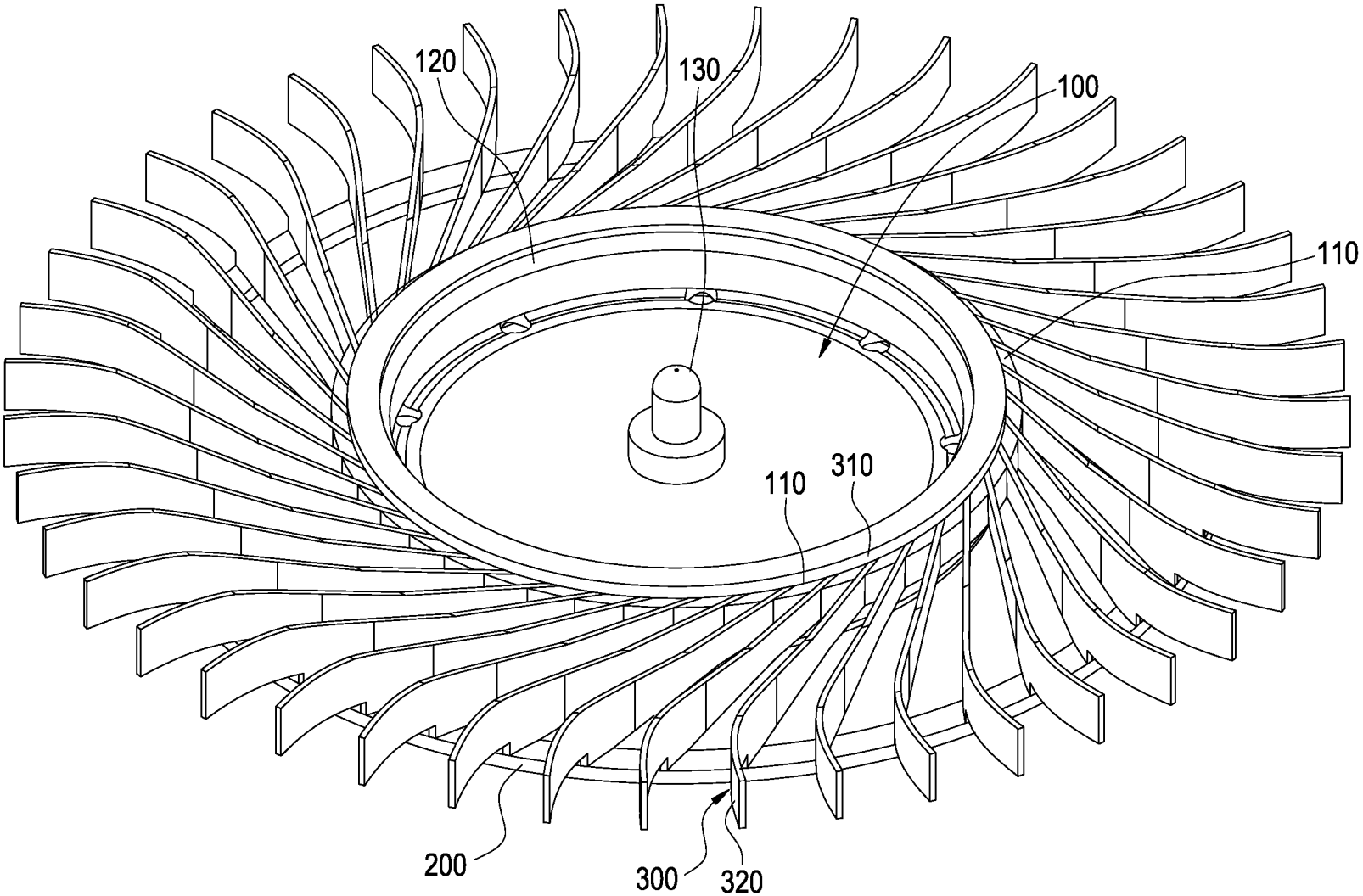
FIG. 12 is a schematic view illustrating the fan impeller manufactured by using the method for manufacturing the fan impeller according to the third embodiment of the present invention.
Figure 13:
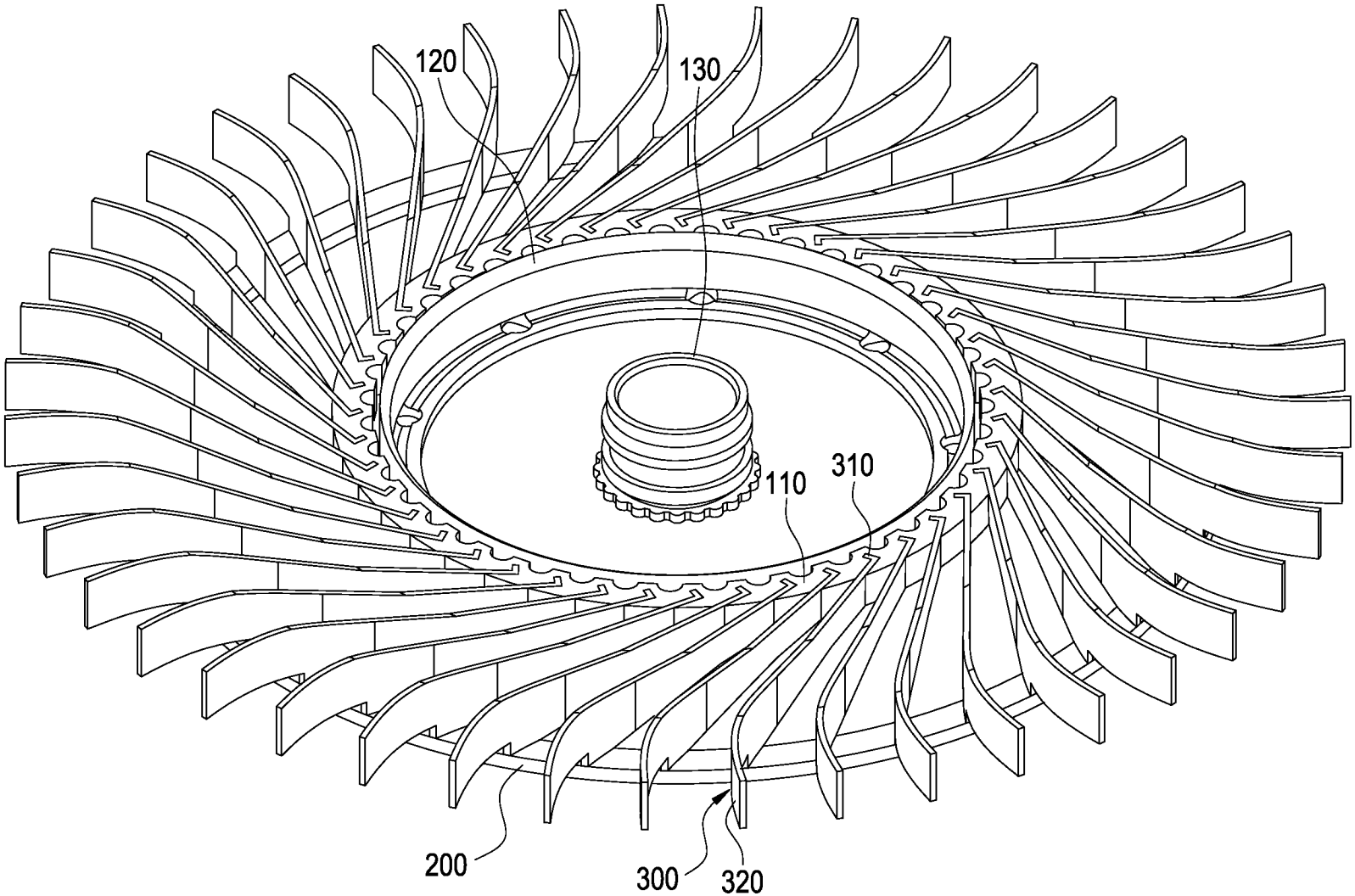
FIG. 13 is a schematic view of the third embodiment of the present invention, illustrating a different design of the rotation shaft unit in the method for manufacturing the fan impeller.

Referring to FIGS. 7 and 12, in step h following the step g, insert molding is performed in the second forming mold to cover the inner circular frame 110, the motor circular cover 120, and the rod-form rotation shaft unit 130 to form a fan hub 100.

Figure 14:
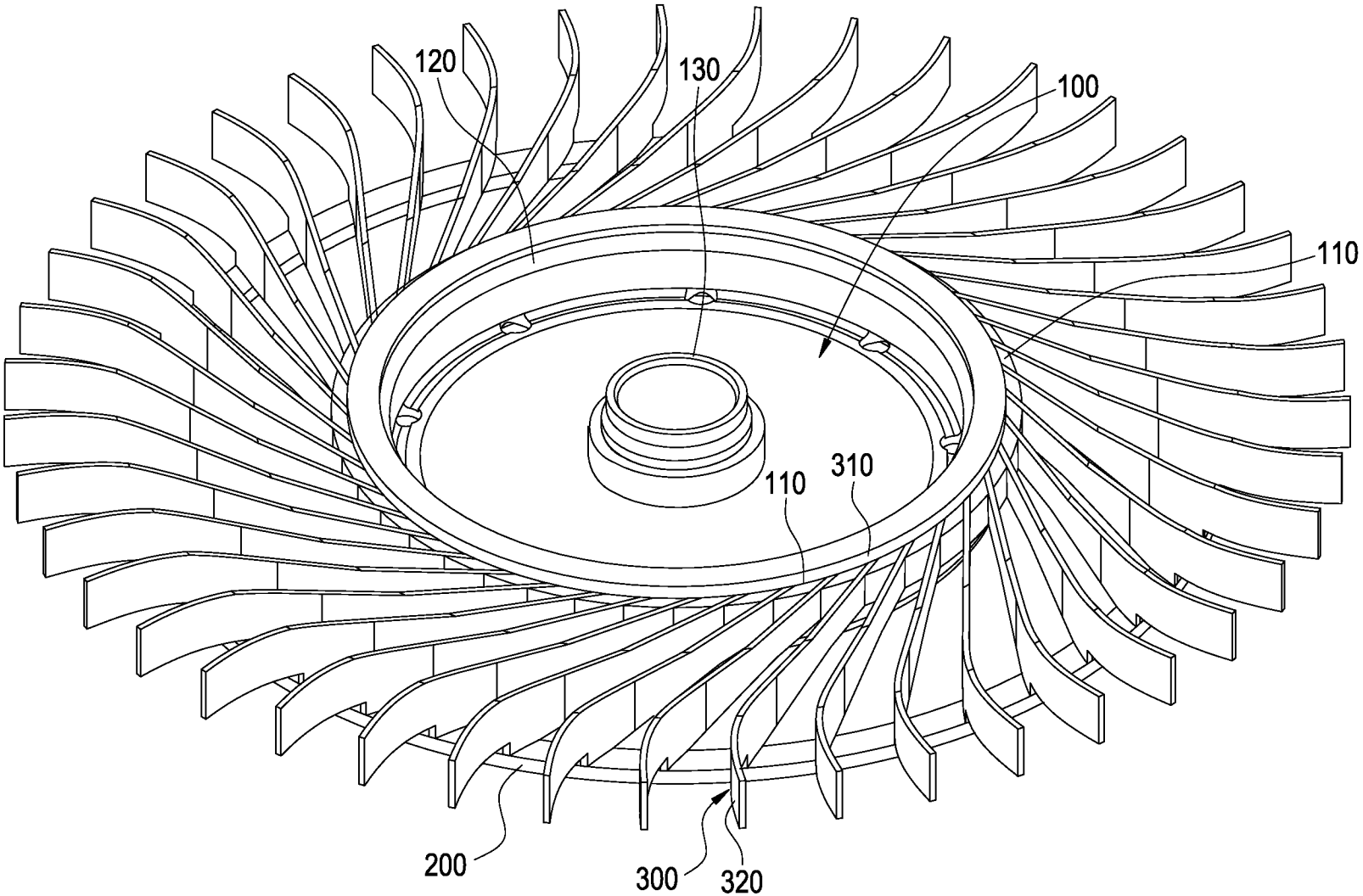
FIG. 14 is a schematic view of the third embodiment of the present invention, illustrating a different design of the fan impeller in the method for manufacturing the fan impeller.

In the method for manufacturing the fan impeller of the present invention, the fan impeller as shown in FIG. 12 is manufactured by the foregoing steps. The rotation shaft unit 130 is inserted in a corresponding cylinder, so that the fan impeller is rotatable. When the rotation shaft unit 130 is the metallic cylinder, the fan impeller is manufactured as the fan impeller shown in FIG. 14. The rotation shaft unit 130 is provided for insertion of a corresponding rod, so that the fan impeller is rotatable.

By using the above-mentioned method for manufacturing the fan impeller, the fan impeller of the present invention, which has the metallic blades, can be manufactured. The metallic blades possess greater structural strength than the conventional plastic blades, and a metallic material can be manufactured into a thinner blade than plastic. Therefore, the fan impeller can include more blades, thereby increasing an air mass flow rate. Accordingly, compared to the conventional plastic fan impeller, the present invention achieves superior heat-dissipation efficiency.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A fan impeller, comprising:

a fan hub;

an outer circular frame having a spaced, radially outbound relationship with respect to the fan hub; and a plurality of metallic blades independent from one another and the outer circular frame and the plurality of metallic blades are independent from one another, two ends of each metallic blade of the plurality of metallic blades being a root and a distal end respectively, and at least a portion of the root of each metallic blade of the plurality of metallic blades being embedded in the fan hub, at least a portion of the distal end of each metallic blade of the plurality of metallic blades being embedded in the outer circular frame;

wherein a through hole is formed on the distal end of each metallic blade of the plurality of metallic blades, and at least a portion of the outer circular frame is disposed in the through hole;

wherein the outer circular frame includes a first thickness and an engagement segment which is inserted in one of the through holes, and the engagement segment has a second thickness which is less than the first thickness.

2. The fan impeller of claim 1, wherein a shape of a cross-section of the engagement segment mates with the shape of the one of the through holes.

3. The fan impeller of claim 1, wherein each metallic blade of the plurality of metallic blades is curve-shaped, and each metallic blade of the plurality of metallic blades has an edge along a line of curvature extending between the root and the distal end of the metallic blade.

4. The fan impeller of claim 1, wherein the root is hook-shaped.

5. A fan impeller, comprising:

a fan hub;

an outer circular frame having a spaced, radially outbound relationship with respect to the fan hub; and a plurality of metallic blades independent from one another and the outer circular frame and the plurality of metallic blades are independent from one another, two ends of each metallic blade of the plurality of metallic blades being a root and a distal end respectively, and at least a portion of the root of each metallic blade of the plurality of metallic blades being embedded in the fan hub and at least a portion of the distal end of each metallic blade of the plurality of metallic blades being embedded in the outer circular frame;

wherein the distal end includes a retention pin that outwardly extends away from a bend of the distal end so that the bend and the retention pin of the distal end, in combination, embeddingly extend in the outer circular frame along a circumference direction of the outer circular frame;

wherein each metallic blade of the plurality of metallic blades is curve-shaped, and each metallic blade of the plurality of metallic blades has an edge along a line of curvature extending between the root and the distal end of the metallic blade.

6. A fan impeller, comprising:

a circular fan hub disposed along a longitudinal axis having a first axial end and a second axial end opposite the first axial end;

an outer circular frame having a spaced, radially outbound relationship with respect to the circular fan hub; and a plurality of metallic blades independent from one another, two ends of each metallic blade of the plurality of metallic blades being a root and a distal end respectively, the root having a bend portion having a length, the bend portion of the root being embedded in the circular fan hub at a position on the circular fan hub intermediate the first axial end and the second axial end, and at least a portion of the distal end of each metallic blade of the plurality of metallic blades being embedded in the outer circular frame, wherein a through hole is formed on the distal end of each metallic blade of the plurality of metallic blades, and at least a portion of the outer circular frame is disposed in each through hole in a manner so that a portion of the distal end of each metallic blade extends radially beyond an outer peripheral edge of the outer circular frame.

* * * * *